US005890649A

United States Patent [19]

Baxter

[11] Patent Number: 5,890,649

[45] Date of Patent: Apr. 6, 1999

[54] CORNER STRUCTURE FOR CARTON

[75] Inventor: Ronald A. Baxter, Douglasville, Ga.

[73] Assignee: The Mead Corporation, Dayton, Ohio

[21] Appl. No.: 984,513

[22] Filed: Dec. 3, 1997

[51] Int. Cl.[6] ..... B65D 3/00

[52] U.S. Cl. ..... 229/182.1; 229/186

[58] Field of Search ..... 229/182.1, 186, 229/189, 108, 103.2, 198.2, 190

[56] References Cited

U.S. PATENT DOCUMENTS

| | | | |
|---|---|---|---|
| 1,485,585 | 3/1924 | Bergstein | 229/190 X |
| 2,724,541 | 11/1955 | Metcalf | 229/190 |
| 3,556,385 | 1/1971 | Kato | 229/190 X |
| 3,701,467 | 10/1972 | Johanson | 229/186 X |
| 4,032,053 | 6/1977 | Wilson | 229/186 X |
| 4,063,679 | 12/1977 | Henry | 229/108 X |
| 5,738,273 | 4/1998 | Auclair | 229/103.2 X |

*Primary Examiner*—Gary E. Elkins
*Assistant Examiner*—Tri M. Mai
*Attorney, Agent, or Firm*—Michael V. Drew

[57] ABSTRACT

A carton (C) has a bottom wall (10) having corners (11) and upright side walls (12, 14) and end walls (16, 18) adjoining the bottom wall. The intersection of the end and side walls having a first triangular-shaped gusset (30) defined by a first pair of fold lines (40, 42) divergingly extending toward the corner of the bottom wall and a second triangular-shaped gusset defined by a second pair of fold lines (44, 46) disposed above the first pair of fold lines divergingly extending away from the first triangular-shaped gusset.

4 Claims, 2 Drawing Sheets

CORNER STRUCTURE FOR CARTON

The invention relates generally to corner structures for cartons, and more particularly to a means for forming a tapered corner for a carton.

It can be appreciated that it would be useful to have a carton whose corners are tapered to provide a snug fitting package of articles, particularly cylindrical articles.

SUMMARY OF THE INVENTION

The present invention provides a carton wherein the bottom wall has corners and wherein upright side and end walls adjoining the bottom wall form intersections at the carton corners. Each carton corner is formed by a first triangular-gusset panel defined by a first pair of fold lines divergingly extending toward the corner of the bottom wall and a second triangular gusset panel defined by a second pair of fold lines disposed above the first pair of fold lines divergingly extending away from the first triangular-gusset panel.

Other advantages and objects of the present invention will be apparent from the following description, the accompanying drawings, and the appended claims.

DETAILED DESCRIPTION OF THE PREFERRED EMBODIMENT

Figure 1:
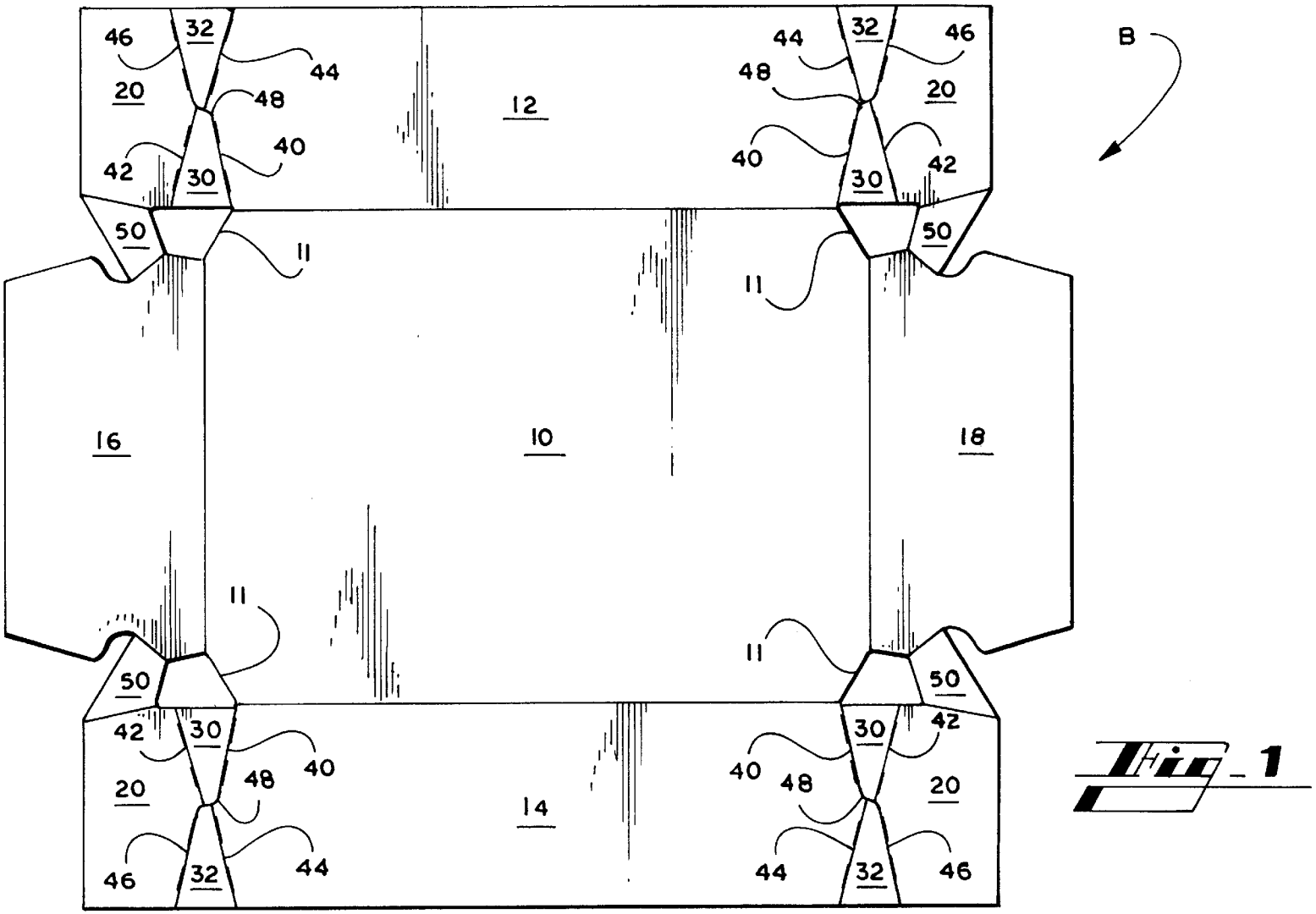
FIG. 1 is a plan view of a blank suitable for forming a carton having tapered corners according to a preferred embodiment of the invention.

Throughout the drawings the same reference numerals are used to denote the same features.

Figure 2:
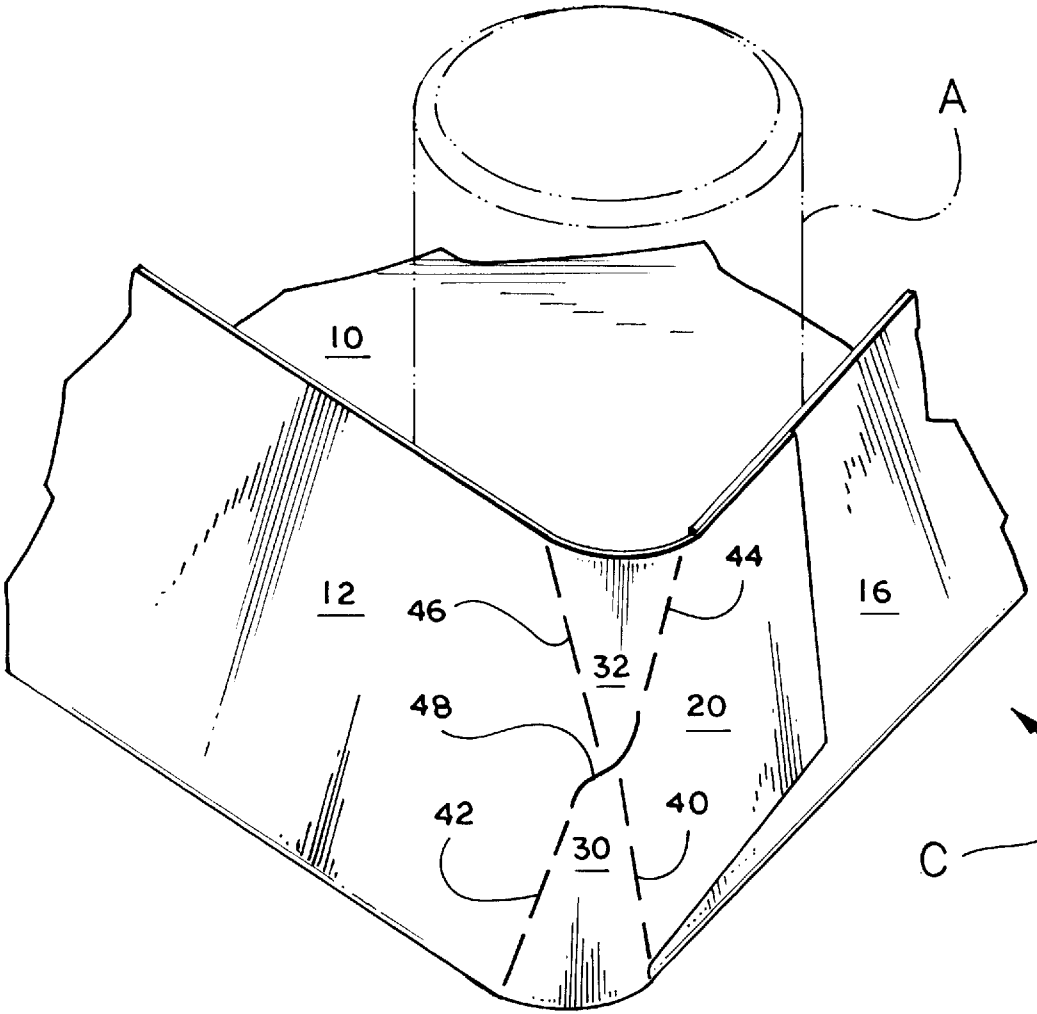
FIG. 2 is an isometric illustration of a carton corner according to a preferred embodiment of the invention formed from the blank of FIG. 1.

Reference is made to FIG. 1 and FIG. 2 simultaneously. A preferred embodiment of the carton C formed from a blank B is shown as a tray-style carton. A bottom wall 12 has corners 11, which in the preferred embodiment illustrated are bevelled. Side walls 12, 14 and end walls 16, 18 are foldably joined to the bottom wall 10. The carton corner-forming structure includes an extension of the side walls 12, 14 which are connectable to the end walls by connecting flaps 20 and webs 50, or other suitable joining structure. Referring now particularly to FIG. 2 but also to FIG. 1, a pair of diametrically opposing triangular-shaped gusset panels 30, 32 for the actual corner of each carton. A first triangular-shaped gusset 30 is defined by a first pair of fold lines 40, 42 divergingly extending toward the corner 11 of the bottom wall 10 and a second triangular-shaped gusset 32 is defined by a second pair of fold lines 44, 46 disposed above the first pair of fold lines divergingly extending away from the first triangular-shaped gusset 30. The triangular-shaped gussets 30, 32 are separated from one another. In the preferred embodiment illustrated the triangular-shaped gussets 30, 32 are separated from one another by a cut line 48. Also as illustrated in the preferred embodiment, the cut line 48 is S-shaped. Further, in the preferred embodiment, ends of the shaped cut line 48 are collinear with fold lines 40, 46 of the gusset panels 30, 32.

The disposition of the two gussets 30, 32 helps produce a tapered carton corner (as shown in FIG. 2) which more closely engages articles A, particularly cylindrical articles, held by the carton C. The separation of the gussets 30, 32 helps inhibit deformation, uneven tearing or binding at the point where the gussets 30, 32 taper inwardly of the point of joinder. Because the ends of the S-shaped cut lines 48 are collinear with the fold lines 40, 46 of the gusset panels 30, 32, the resulting structure helps direct stress at the carton C corners in a manner which is not destructive of the corners.

Modifications may be made in the foregoing without departing from the scope and spirit of the claimed invention. For example, although the carton C and blank B illustrated are for the tray-style carton, the invention is equally effective with a carton which has a top wall or closure.

What is claimed is:

1. A carton comprising:

a bottom wall having corners;

upright side walls adjoining said bottom wall; and upright end walls adjoining said bottom wall;

wherein an intersection of said side walls and said end walls includes a first triangular-shaped gusset defined by a first pair of fold lines divergingly extending toward a corresponding one of said corners of said bottom wall and a second triangular-shaped gusset defined by a second pair of fold lines disposed above the first pair of fold lines divergingly extending away from the first triangular-shaped gusset such that a tapered carton corner having adjacent vertices of said first triangular-shaped gusset and said second triangular-shaped gusset is thereby formed; and wherein said adjacent vertices of said first triangular-shaped gusset and said second triangular-shaped gusset are disjoined by a cut line.

2. The carton of claim 1, said bottom wall having bevelled corners.

3. The carton of claim 2, wherein said cut line is a substantially S-shaped cut line.

4. The carton of claim 3, wherein ends of each of said S-shaped cut lines are substantially collinear with one of said first pair of fold lines and one of said second pair of fold lines.

* * * * *